US008973788B1

(12) United States Patent
Burns

(10) Patent No.: US 8,973,788 B1
(45) Date of Patent: Mar. 10, 2015

(54) PORTABLE HAND SANITIZER DISPENSER

(71) Applicant: Kevin A. Burns, Richmond Hill (CA)

(72) Inventor: Kevin A. Burns, Richmond Hill (CA)

( * ) Notice: Subject to any disclaimer, the term of this patent is extended or adjusted under 35 U.S.C. 154(b) by 5 days.

(21) Appl. No.: 13/959,292

(22) Filed: Aug. 5, 2013

Related U.S. Application Data

(63) Continuation-in-part of application No. 12/872,962, filed on Aug. 31, 2010, now abandoned.

(51) Int. Cl.
*B67D 7/84* (2010.01)
*A47K 5/12* (2006.01)

(52) U.S. Cl.
CPC ..... *A47K 5/1201* (2013.01)
USPC ..... 222/175; 222/180; 222/210; 222/212; 24/3.11; 220/751

(58) Field of Classification Search
USPC ..... 222/175, 180–181.2, 192, 206, 210, 222/212, 465.1, 562; 24/3.11–3.12; 215/386, 396, 399; 267/154, 155, 174, 267/178; 220/475, 480, 751; 248/320, 322
See application file for complete search history.

(56) References Cited

U.S. PATENT DOCUMENTS 1,516,875 A * 11/1924 Allen et al. ..... 59/95
2,809,766 A * 10/1957 Anderson ..... 220/326
3,880,311 A * 4/1975 McPhee ..... 215/365
4,309,052 A * 1/1982 Drayton ..... 294/82.2
4,747,519 A * 5/1988 Green et al. ..... 222/181.3
5,261,570 A * 11/1993 Hippely et al. ..... 222/212
5,634,246 A * 6/1997 Jermyn, Jr. ..... 24/601.5
5,749,497 A * 5/1998 Davis ..... 222/181.2
5,927,548 A 7/1999 Villaveces
5,938,363 A 8/1999 Timms et al.
6,209,179 B1 * 4/2001 Shou-Mao ..... 24/598.4
6,234,357 B1 5/2001 Lewis
6,283,334 B1 * 9/2001 Mahaffey et al. ..... 222/175
6,481,590 B1 * 11/2002 Simkins ..... 215/399
7,025,231 B2 * 4/2006 Rutherford et al. ..... 222/181.3
7,156,268 B2 * 1/2007 Whitney ..... 222/539
7,285,114 B2 10/2007 Harper
7,377,709 B2 5/2008 Butler
7,562,856 B2 * 7/2009 Arakawa ..... 248/339
7,571,523 B2 * 8/2009 Beed ..... 24/600.2
7,690,540 B1 * 4/2010 Owens ..... 222/642
7,854,357 B2 * 12/2010 Hill ..... 222/475
8,215,511 B1 * 7/2012 Lin ..... 220/212.5
8,510,984 B2 * 8/2013 Burgeson ..... 43/1
2001/0037542 A1 * 11/2001 Elliott ..... 24/3.11
2010/0282703 A1 * 11/2010 Yang ..... 215/228
2012/0067912 A1 * 3/2012 Stein ..... 220/751

* cited by examiner

*Primary Examiner* — Patrick M Buechner
(74) *Attorney, Agent, or Firm* — Crossley Patent Law

(57) ABSTRACT

A portable hand sanitizer dispenser which contains hand sanitizer within an internal cavity, and which includes a dispensing body having tapered left and right sides and a U-shaped opening on a top end thereof, a pivotally attached metal clip across the opening by which user clips the dispenser onto an item, such as a belt loop, and also including a grip pad member on a front side having rows of spaced apart protuberances thereon thereby enhancing the ability to grip the dispenser during use.

3 Claims, 4 Drawing Sheets

PORTABLE HAND SANITIZER DISPENSER

I claim benefit of my U.S. application Ser. No. 12/872,962 filed Aug. 31, 2010.

BACKGROUND OF THE INVENTION

Various types of hand sanitizer dispensers are known in the prior art. However, what is needed is a portable hand sanitizer dispenser that clips onto an item.

FIELD OF THE INVENTION

The present invention relates to dispensers, and more particularly, to a portable hand sanitizer dispenser.

SUMMARY OF THE INVENTION

The general purpose of the present portable hand sanitizer dispenser, described subsequently in greater detail, is to provide a portable hand sanitizer dispenser which has many novel features that result in a portable hand sanitizer dispenser which is not anticipated, rendered obvious, suggested, or even implied by prior art, either alone or in combination thereof.

To accomplish this, the present portable hand sanitizer dispenser includes a lightweight dispensing body with tapered left and right sides and a front and rear sides. A substantially U-shaped opening, which is centrally disposed on a top end of the dispensing body, has a bottom surface, an inner surface proximal to the left side, and an interior surface proximal to the right side. An integral protrusion of the dispensing body extends inwardly between the front side and the rear side from a top edge of the interior surface and is disposed in a position parallel to the opening bottom surface. A bottom side of the dispensing body has an integral threaded cylindrical spout centrally disposed therein and a screw cap, having an aperture therein, removably engaged thereto. The dispensing body has an internal cavity defined by the opening bottom surface, the bottom side, and a portion of the left side and of the right side disposed between the opening bottom surface and the bottom side. A liquid-type hand sanitizer is contained within the internal cavity, but other products such as hand cream or sunscreen may also be stored therein.

The hand sanitizer dispenser also includes a thin parallelepiped clip member having a spring-loaded pivot member disposed inner edge thereof and also having an outer edge releasably attached to a lower edge of the protrusion. A pivot activation button, which is disposed on the top end for convenient accessibility, is in operational communication with the pivot member.

Activation of the pivot engagement button releases the pivot member. Upon release of the pivot member, the outer edge of the clip member is released from the lower edge of the protrusion. Upon release of the clip member outer edge, the clip member pivots downwardly, whereby the dispensing body is alternately attached to and released from an item for enhanced accessibility by and convenience of the user. The item includes, by way of example, a belt loop, a strap, a cylindrical body such as a handle on a stroller or on a grocery cart. The present hand sanitizer dispenser may also be clipped onto other apparel and items.

An integral grip pad member disposed on the front side includes a plurality of horizontally aligned protuberances having a rounded outer surface. The grip pad member provides a surface for gripping while clipping the hand sanitizer dispenser onto an item and also while unscrewing the cap from the spout.

The dispensing body has a maximum height in a range of 2 inches to 2¾ inches. The dispensing body has a width of approximately 1⅛ inches proximal to the cap, a maximum width of approximately 5/16 inch proximal to the grip pad member, and a width of approximately ¼inch proximal to the top end. The dimensions of the dispensing body enhance the portability of the hand sanitizer dispenser for use, for example, while a user is mobile or outdoors. The instant portable hand sanitizer dispenser may be reused an unlimited number of times and can be easily transported to and used at almost any location thereby reducing illnesses through contact with germs and preventing the spread of disease.

The present hand sanitizer dispenser is formed of plastic or another lightweight material. The internal cavity is impermeable to prevent leakage of the hand sanitizer therefrom. The present device is further produced is a wide range of colors.

Thus has been broadly outlined the more important features of the present portable hand sanitizer dispenser so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
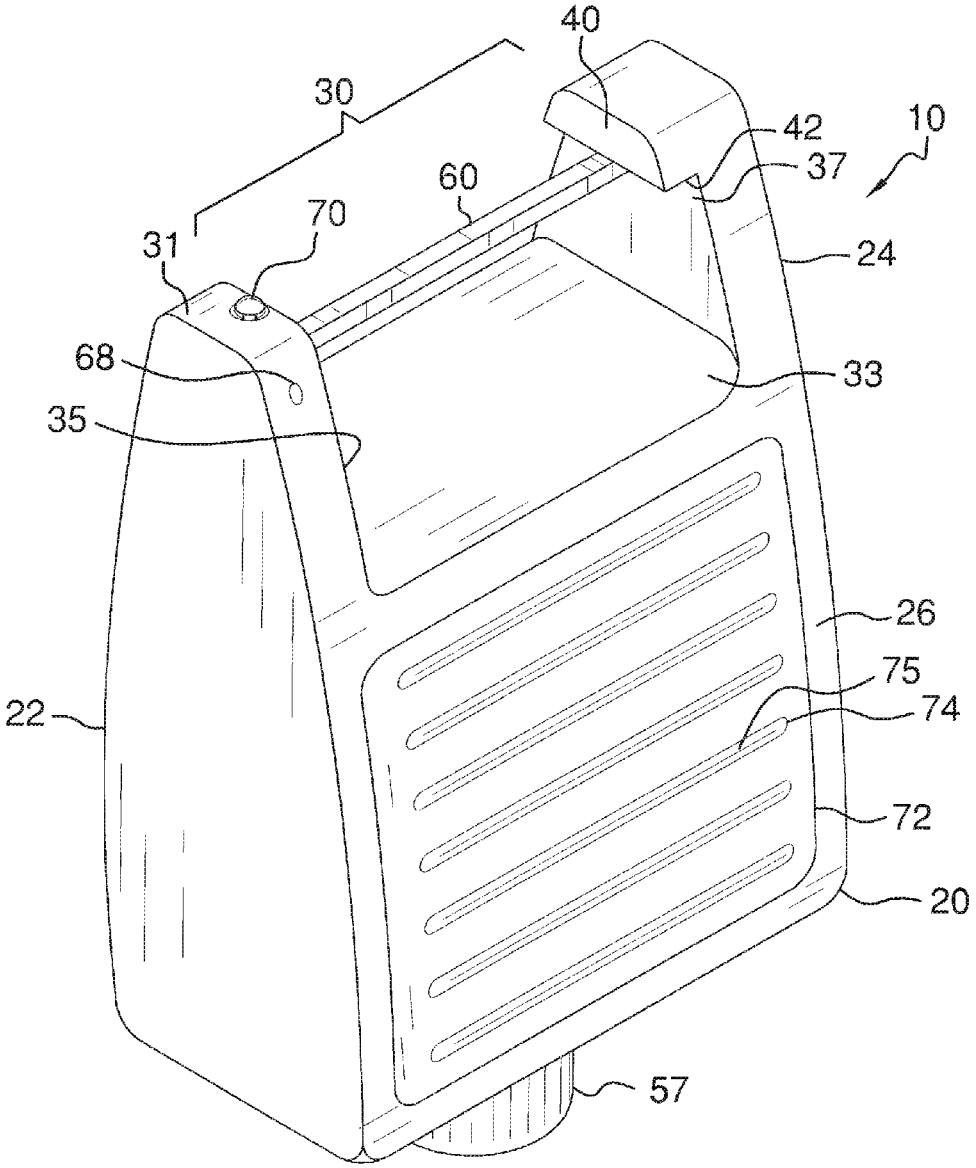
FIG. 1 is an isometric view.
Figure 2:
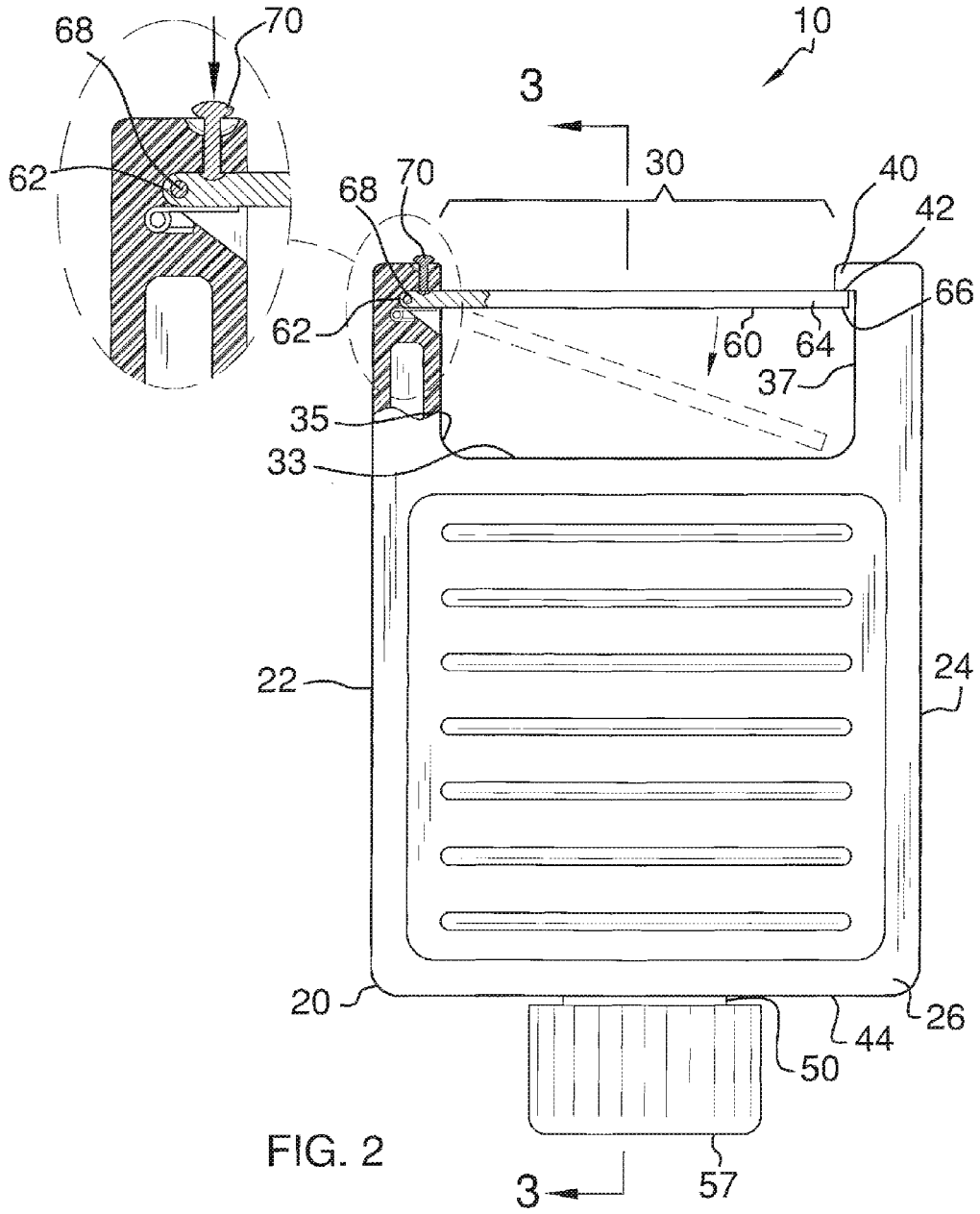
FIG. 2 is a front elevation view.
Figure 3:
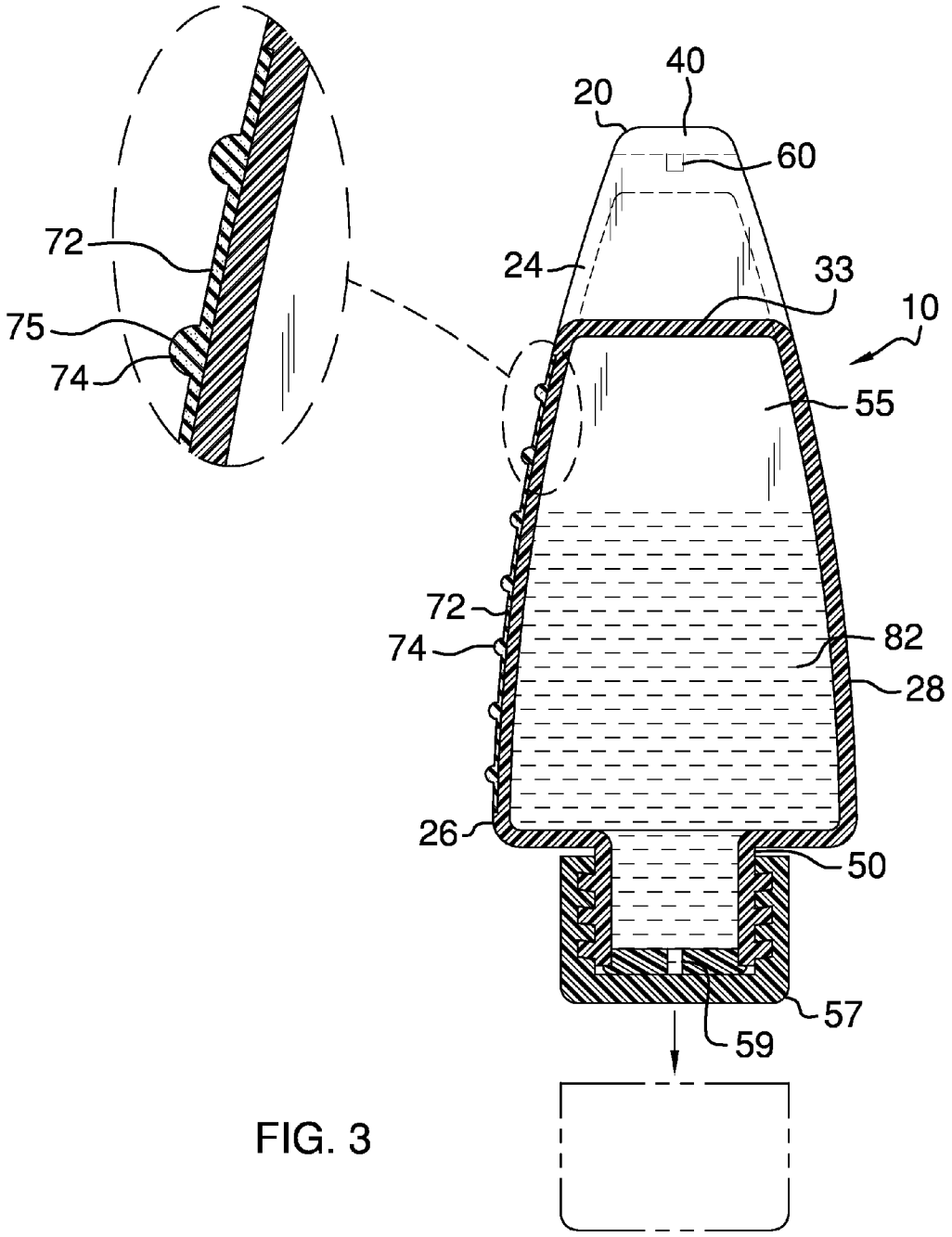
FIG. 3 is a cross-section view taken along line 3-3 of FIG. 2.

With reference now to the drawings, and in particular FIGS. 1 through 4 thereof, example of the instant portable hand sanitizer dispenser employing the principles and concepts of the present portable hand sanitizer dispenser and generally designated by the reference number 10 will be described.

Referring to FIGS. 1 through 4 a preferred embodiment of the present portable hand sanitizer dispenser 10 is illustrated. The portable hand sanitizer dispenser 10 includes a lightweight dispensing body 20. The dispensing body 20 includes a left side 22 and an opposing right side 24. The dispensing body 20 also includes a front side 26 and an opposing rear side 28.

A substantially U-shaped opening 30 centrally disposed therein on a top end 31 of the dispensing body 20. The U-shaped opening 30 has a bottom surface 33, an inner surface 35 proximal to the left side 22, and an interior surface 37 proximal to the right side 24. An integral protrusion 40 of the dispensing body 20 extends inwardly between the front side 26 and the rear side 28 from a top edge 42 of the interior surface 37. The protrusion 40 is disposed in a position parallel to the opening 30 bottom surface 33.

The dispensing body 20 also has a bottom side 44 having an integral threaded cylindrical spout 50 centrally disposed therein. An internal cavity 55 is disposed within the dispensing body 20. The internal cavity 55 is defined by the opening 30 bottom surface 33, the bottom side 44, and a portion of the left side 22 and of the right side 24 disposed between the opening 30 bottom surface 33 and the bottom side 44. A threaded screw cap 57 removably engages the spout 50. The spout 50 has an aperture 59 centrally disposed therein. A liquid-type hand sanitizer 82 is contained within the internal cavity 55; however, other products such as hand cream or sunscreen may also be stored within the internal cavity 55 of the dispensing body 20. The spout 50 is disposed on the bottom side 44 to allow gravity flow of the hand sanitizer 82 from the internal cavity 55.

The hand sanitizer dispensing body 10 also includes a thin parallelepiped clip member 60 having a width greater than a height thereof. The clip member 60 includes an inner edge 62 and also an outer edge 64, which is releasably attached to a lower edge 66 of the protrusion 40. A spring-loaded pivot member 68 is disposed on the inner edge 62. A pivot activation button 70, which is disposed on the top end 31 between the inner surface 35 and the left side 22, is in operational communication with the pivot member 68.

Figure 4:
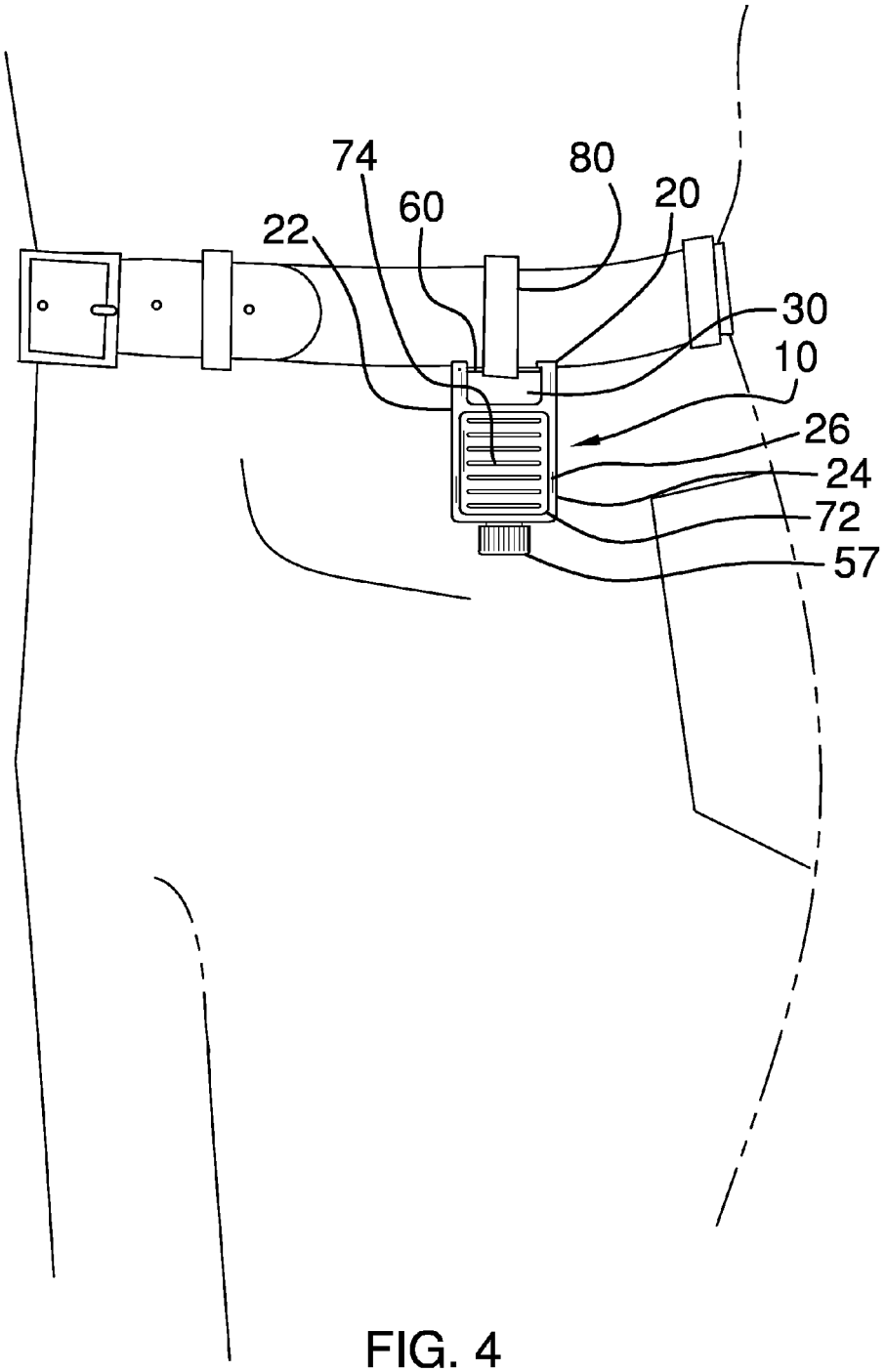
FIG. 4 is a in-use side elevation view.

Upon activation of the pivot activation button 70, the pivot activation button 70 engages the clip member 60 and releases the pivot member 68 from a static position to permit the clip member 60 to pivot toward the bottom surface 33. Upon release of the pivot member 68, the outer edge 64 of the clip member 60 is released from the lower edge 66 of the protrusion 40. Upon release of the clip member 40 outer edge 66, the clip member 40 pivots downwardly, whereby the dispensing body 20 is alternately attached to and released from an item 80 for enhanced accessibility by and convenience of the user. The item 80 includes, by way of example, a belt loop, as shown in FIG. 4, a strap, a cylindrical body such as a handle on a stroller or on a grocery cart. The present hand sanitizer dispenser 10 may also be clipped onto other apparel and items.

An integral grip pad member 72 is centrally disposed on the front side 26 in a position below the U-shaped opening 30. The grip pad member 72 includes a plurality of spaced apart horizontally-aligned elongated protuberances 74 centrally disposed thereon. The protuberances 74 are disposed in a position parallel to the opening 30 bottom surface 33. Each of the protuberances 74 has a rounded outer surface 75. The grip pad member 72 provides a surface for gripping while clipping the hand sanitizer dispenser 10 onto an item 80 and also while unscrewing the cap 57 from the spout 50.

The dispensing body 20 has a maximum height in a range of 2 inches to 2¾ inches. The dispensing body 20 has a width of approximately 1⅛ inches proximal to the cap 57, a maximum width of approximately 5/16 inch proximal to the grip pad member 72, and a width of approximately ¼inch proximal to the top end 31. The dimensions of the dispensing body 20 enhance the portability of the hand sanitizer dispenser 10 for utilization of the device 10, for example, while a user is mobile or outdoors and the ability to easily hold onto the dispensing body with a single hand. The left and right sides 22, 24 are tapered to further enhance the ability to hold onto the dispensing body 20 with a single hand while carrying the present device 10 and while removing the cap 57 from the spout 50.

What is claimed is:

1. A portable hand sanitizer dispenser comprising:

an impermeable dispensing body comprising:

a left side;

an opposing right side;

a front side;

an opposing rear side;

a U-shaped opening centrally disposed therein on a top end of the dispensing body, the U-shaped opening having a bottom surface, an inner surface proximal to the left side, and an interior surface proximal to the right side;

an integral protrusion extending inwardly between the front side and the rear side from a top edge of the interior surface, the protrusion disposed in a position parallel to the U-shaped opening bottom surface;

a bottom side having an integral threaded cylindrical spout centrally disposed therein;

an internal cavity disposed within the dispensing body, the internal cavity defined by the U-shaped opening bottom surface, the bottom side, and a portion of the left side and of the right side disposed between the U-shaped opening bottom surface and the bottom side;

a threaded screw cap removably engaged to the spout, the spout having an aperture centrally disposed therein;

a thin parallelepiped clip member having a width greater than a height thereof, the clip member comprising:

an inner edge;

an outer edge releasably attached to a lower edge of the protrusion;

a spring-loaded pivot member disposed on the inner edge;

a pivot activation button disposed on the top end between the inner surface and the left side, the pivot activation button in operational communication with the pivot member;

wherein activation of the pivot activation button releases the pivot member;

wherein upon release of the pivot member, the outer edge of the clip member is released from the lower edge of the protrusion;

wherein upon release of the clip member outer edge, the clip member pivots downwardly, whereby the dispensing body is alternately attached to and released from an item.

2. The hand sanitizer dispenser of claim 1 further comprising;

an integral grip pad member centrally disposed on the front side in a position below the U-shaped opening, the grip pad member comprising:

a plurality of spaced apart horizontally-aligned elongated protuberances centrally disposed thereon, the protuberances in a position parallel to the U-shaped opening bottom surface, each of the protuberances having a rounded outer surface.

3. The hand sanitizer dispenser of claim 2 wherein the dispensing body has a maximum height in a range of 2 inches to 2¾ inches;

wherein the dispensing body has a width of 1⅛ inches proximal to the cap, a maximum width of 5/16 inch proximal to the grip pad member, and a width of ¼ inch proximal to the top end.

* * * * *